US010724335B2

(12) United States Patent
Ledingham et al.

(10) Patent No.: US 10,724,335 B2
(45) Date of Patent: Jul. 28, 2020

(54) HIGH PRESSURE REGULATION FOR A BALL VALVE

(71) Applicant: Halliburton Energy Services, Inc., Houston, TX (US)

(72) Inventors: Steven Alistair Ledingham, Aberdeen Aberdeenshire (GB); Peter D W Inglis, Dundee Tayside (GB); Rory Archibald Napier, Montrose Fife (GB)

(73) Assignee: Halliburton Energy Services, Inc., Houston, TX (US)

( * ) Notice: Subject to any disclaimer, the term of this patent is extended or adjusted under 35 U.S.C. 154(b) by 162 days.

(21) Appl. No.: 15/736,212

(22) PCT Filed: Jul. 14, 2015

(86) PCT No.: PCT/US2015/040284
§ 371 (c)(1),
(2) Date: Dec. 13, 2017

(87) PCT Pub. No.: WO2017/010990
PCT Pub. Date: Jan. 19, 2017

(65) Prior Publication Data

US 2018/0187515 A1 Jul. 5, 2018

(51) Int. Cl.
*E21B 34/10* (2006.01)
*E21B 34/00* (2006.01)

(52) U.S. Cl.
CPC ..... *E21B 34/10* (2013.01); *E21B 2034/002* (2013.01)

(58) Field of Classification Search
CPC ..... E21B 2034/002; E21B 34/10
USPC ..... 166/374
See application file for complete search history.

(56) References Cited

U.S. PATENT DOCUMENTS

| | | | | |
|---|---|---|---|---|
| 4,979,568 | A | 12/1990 | Spencer et al. | |
| 6,321,847 | B1 | 11/2001 | Brown | |
| 2012/0085542 | A1* | 4/2012 | Hayter | E21B 23/006 166/332.4 |
| 2012/0234607 | A1 | 9/2012 | Kinsella | |
| 2013/0000917 | A1 | 1/2013 | Slack et al. | |
| 2013/0118758 | A1 | 5/2013 | Caminari | |
| 2013/0206417 | A1 | 8/2013 | Kalb et al. | |
| 2013/0341011 | A1 | 12/2013 | Ringgenberg et al. | |

(Continued)

OTHER PUBLICATIONS

International Preliminary Report on Patentability for PCT Patent Application No. PCT/US2015/040284, dated Jan. 25, 2018; 10 pages.

(Continued)

*Primary Examiner* — Taras P Bemko
(74) *Attorney, Agent, or Firm* — Baker Botts L.L.P.

(57) ABSTRACT

In accordance with some embodiments of the present disclosure, a high pressure regulation system for a ball valve used in a wellbore is disclosed. The high pressure ball valve includes an outer wall, an inner wall disposed in the outer wall, a tubing defined by an inner diameter of the inner wall, an annulus defined by an outer diameter of the inner wall and an inner diameter of the outer wall, a lower chamber formed in the annulus, and a relief valve fluidically coupled to the lower chamber. The relief valve is to control a pressure differential between a pressure in the lower chamber and a pressure in the tubing.

20 Claims, 5 Drawing Sheets

(56) References Cited

U.S. PATENT DOCUMENTS

2014/0231092 A1 8/2014 Mock et al.

OTHER PUBLICATIONS

Search Report and Written Opinion for Singapore Patent Application No. 11201710149U, dated Jul. 10, 2018; 8 pages.
Office Action for Canadian Patent Application No. 2988083, dated Aug. 31, 2018; 4 pages.
International Search Report and Written Opinion for PCT Patent Application No. PCT/US2015/040284, dated Mar. 21, 2016; 14 pages.
Office Action for Singapore Patent Application No. 11201710149U, dated Aug. 1, 2019; 6 pages.

* cited by examiner

HIGH PRESSURE REGULATION FOR A BALL VALVE

RELATED APPLICATIONS

This application is a U.S. National Stage Application of International Application No. PCT/US2015/040284 filed Jul. 14, 2015, which designates the United States, and which is incorporated herein by reference in its entirety.

TECHNICAL FIELD

The present disclosure relates generally to well drilling and hydrocarbon recovery operations and, more particularly, to regulating high pressure in a ball valve for use in a wellbore.

BACKGROUND

During recovery operations in a wellbore, different stimulation techniques may be performed downhole, including nitrogen circulation, acidizing, fracturing, or a combination of acidizing and fracturing. Acidizing and nitrogen circulation are designed to clean up residues and skin damage in the wellbore in order to improve the flow of hydrocarbons. Fracturing is designed to create fractures in the formation surrounding the wellbore to allow hydrocarbons to flow from a reservoir into the wellbore. To enable the use of these stimulation techniques, perforations, or holes, may be created in a downhole casing in the wellbore. The perforations allow acid and other fluids to flow from the wellbore into the surrounding formation. The perforations may also allow hydrocarbons to flow into the wellbore from fractures in the formation created during fracturing techniques.

Recovery operations may also include using one or more ball valves to provide control of fluids to and from the formation. The ball valve isolates the portions of the formation downhole from the ball valve to prevent fluids from flowing into the formation from uphole and prevent fluids from flowing uphole from the formation during stimulation operations performed uphole from the formation.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

A high pressure regulation system for a ball valve is disclosed. The ball valve may operate under high pressure conditions and includes a tubing defined by an inner wall and an annulus defined by the inner wall and an outer wall. The annulus includes a lower chamber. A check valve controls the flow of fluid between the tubing and the lower chamber. The check valve allows fluid to flow into the lower chamber and restricts the flow out of the lower chamber. A relief valve limits the pressure differential between the pressure in the lower chamber and the pressure in the tubing. By limiting the pressure differential, the pressure range of the operating window of the ball valve is decreased and the thickness of the inner wall and the amount of material used to produce the high pressure ball valve may be reduced, which decreases the manufacturing cost of the ball valve. Additionally, flexing of the inner wall caused by a high pressure differential may be reduced. Accordingly, a high pressure ball valve may be formed in accordance with the teachings of the present disclosure and may have different designs, configurations, and/or parameters according to a particular application. Embodiments of the present disclosure and its advantages are best understood by referring to FIGS. 1 through 4, where like numbers are used to indicate like and corresponding parts.

Figure 1:
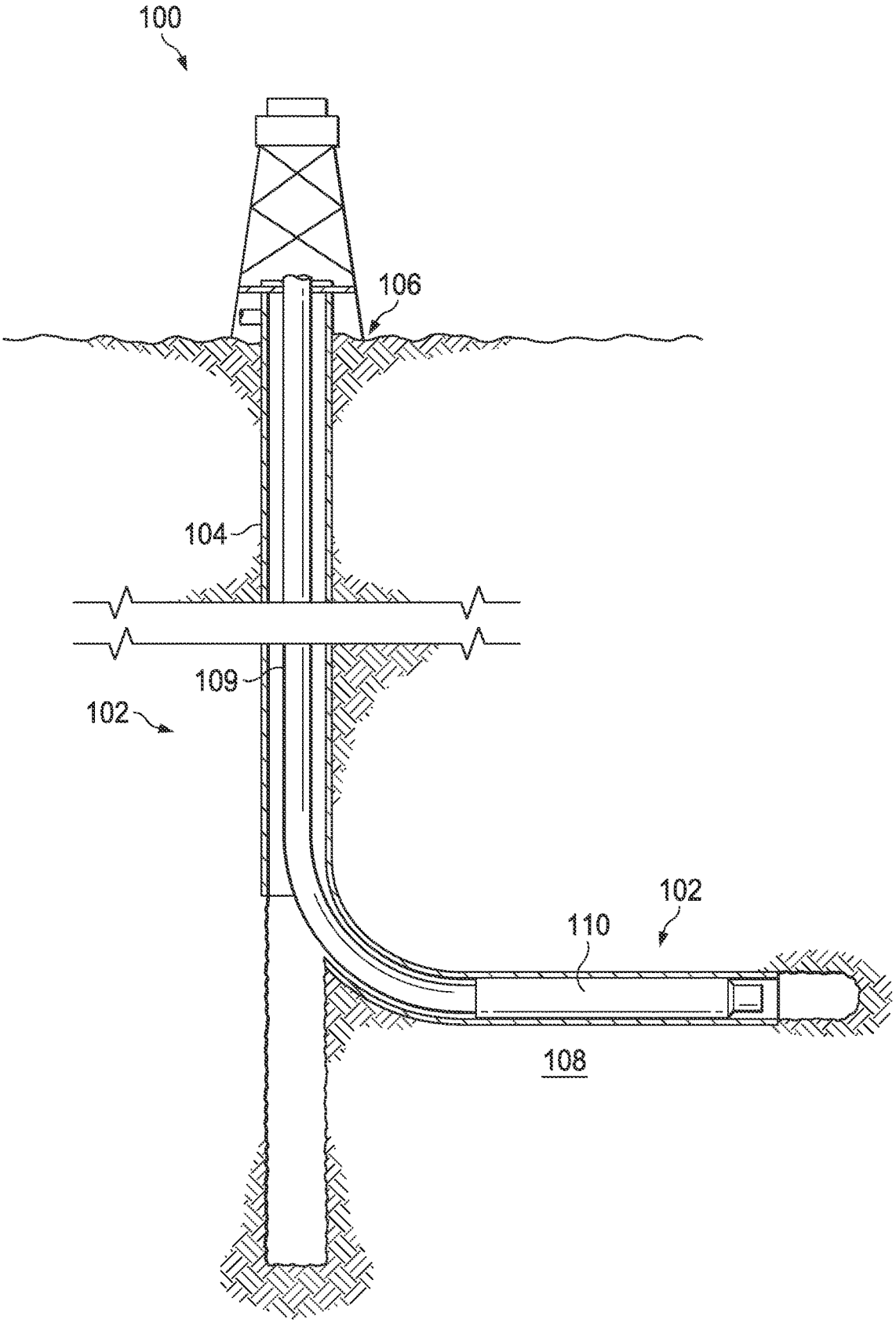
FIG. 1 illustrates an elevation view of an example embodiment of a subterranean operations system.

FIG. 1 illustrates an elevation view of an example embodiment of a subterranean operations system. In the illustrated embodiment, subterranean operations system 100 may be associated with land-based subterranean operations. However, subterranean operations tools incorporating teachings of the present disclosure may be satisfactorily used with subterranean operations equipment located on offshore platforms, drill ships, semi-submersibles, and drilling barges.

Subterranean operations system 100 includes wellbore 102 that is defined in part by casing string 104 extending from well surface 106 to a selected downhole location. Uphole may be used to refer to a portion of wellbore 102 that is closer to well surface 106 and downhole may be used to refer to a portion of wellbore 102 that is further from well surface 106. Portions of wellbore 102 that do not include casing string 104 may be described as open hole.

Various types of fluid, such as oil, water, or gas, may be pumped from downhole to well surface 106 through wellbore 102. Additionally, other types of fluids, such as stimulation fluids and fracturing fluids, may be pumped from well surface 106 to areas of wellbore 102 near formation 108. As shown in FIG. 1, wellbore 102 may be substantially vertical (e.g., substantially perpendicular to the surface), substantially horizontal (e.g., substantially parallel to the surface), or at an angle between vertical and horizontal.

Ball valve 110 may be positioned in wellbore 102 to prevent fluids from flowing to and from formation 108 when ball valve 110 is in a closed position. In some examples, ball valve 110 is installed in wellbore 102 to isolate formation 108 during completion operations performed on the portions of wellbore 102 uphole from ball valve 110. Completion operations include any suitable completion operations including installation of casing string 104, stimulation techniques, and pressure testing of wellbore 102. Ball valve 110 may be coupled to sections of production tubing 109 which may communicate fluids to and from ball valve 110. In some installations, ball valve 110 may be installed downhole from a packer (not expressly shown) that isolates the annular space in the wellbore such that any fluid flowing from formation 108 to well surface 106 flows through ball valve 110.

Once isolation of formation 108 is complete, for example when completion operations in the uphole portions of wellbore 102 are finished, ball valve 110 is opened to allow fluids to flow to and from formation 108. Ball valve 110 may be opened by applying pressure cycles to ball valve 110, as explained in further detail with respect to FIGS. 2-4. For example, drilling fluid or water may be pumped downhole to increase the pressure in ball valve 110. Once the pressure in ball valve 110 is increased, the drilling fluid or water may be pumped uphole to decrease the pressure in ball valve 110. The increase and decrease of the pressure in ball valve 110 may create a pressure differential that causes a mechanism in the ball valve to operate and open the ball valve. A pressure cycle may include one increase in pressure in ball valve 110 and the subsequent decrease in pressure in ball valve 110. Ball valve 110 may be designed to open after a predetermined number of pressure cycles. For example, each pressure cycle causes an axial movement of a piston in ball valve 110. The distance the piston moves axially during a single pressure cycle is referred to as the stroke length. When a piston has moved the complete distance of the travel path of the piston, a latch in the ball valve may become unsupported and allow springs to push ball valve 110 open. The predetermined number of pressure cycles used to open ball valve 110 may be calculated by dividing the total movement distance of the piston by the stroke length of the piston.

Figure 2A:
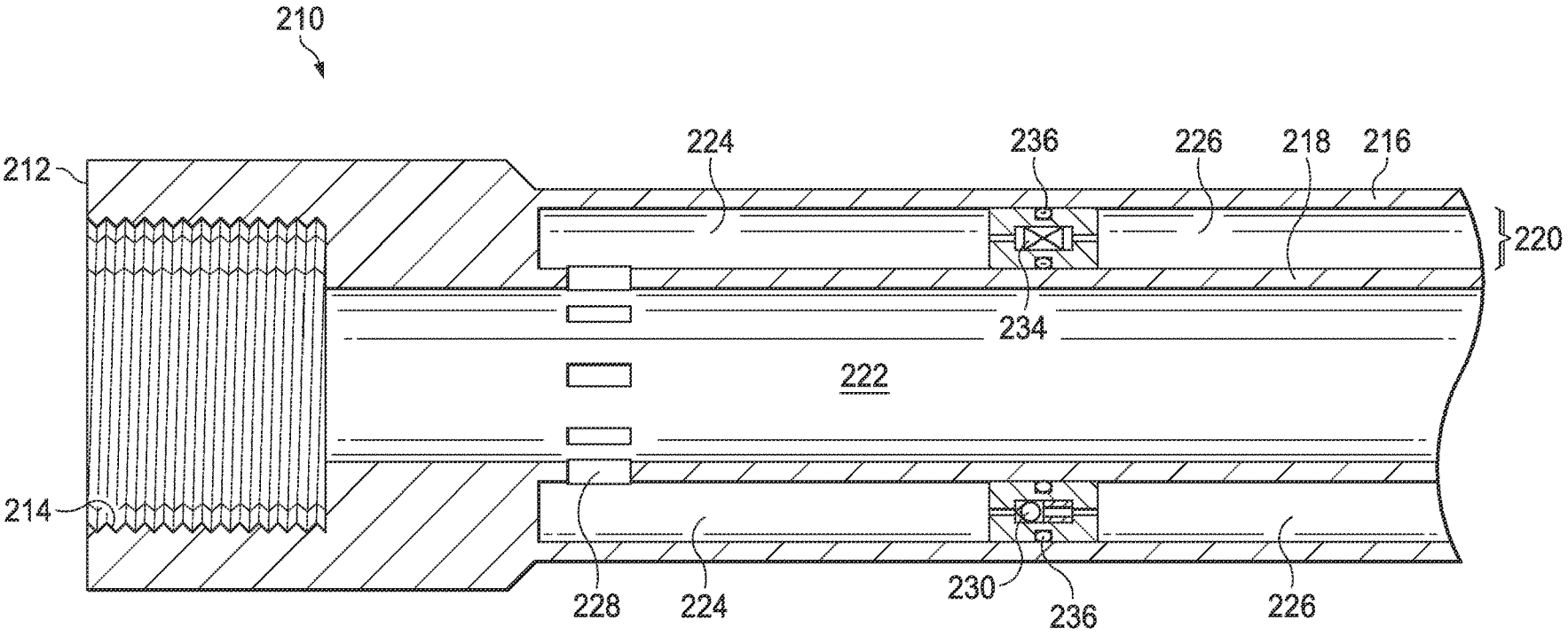
FIG. 2A illustrates a detailed cross-sectional view of an uphole end of a high pressure ball valve.
Figure 2B:
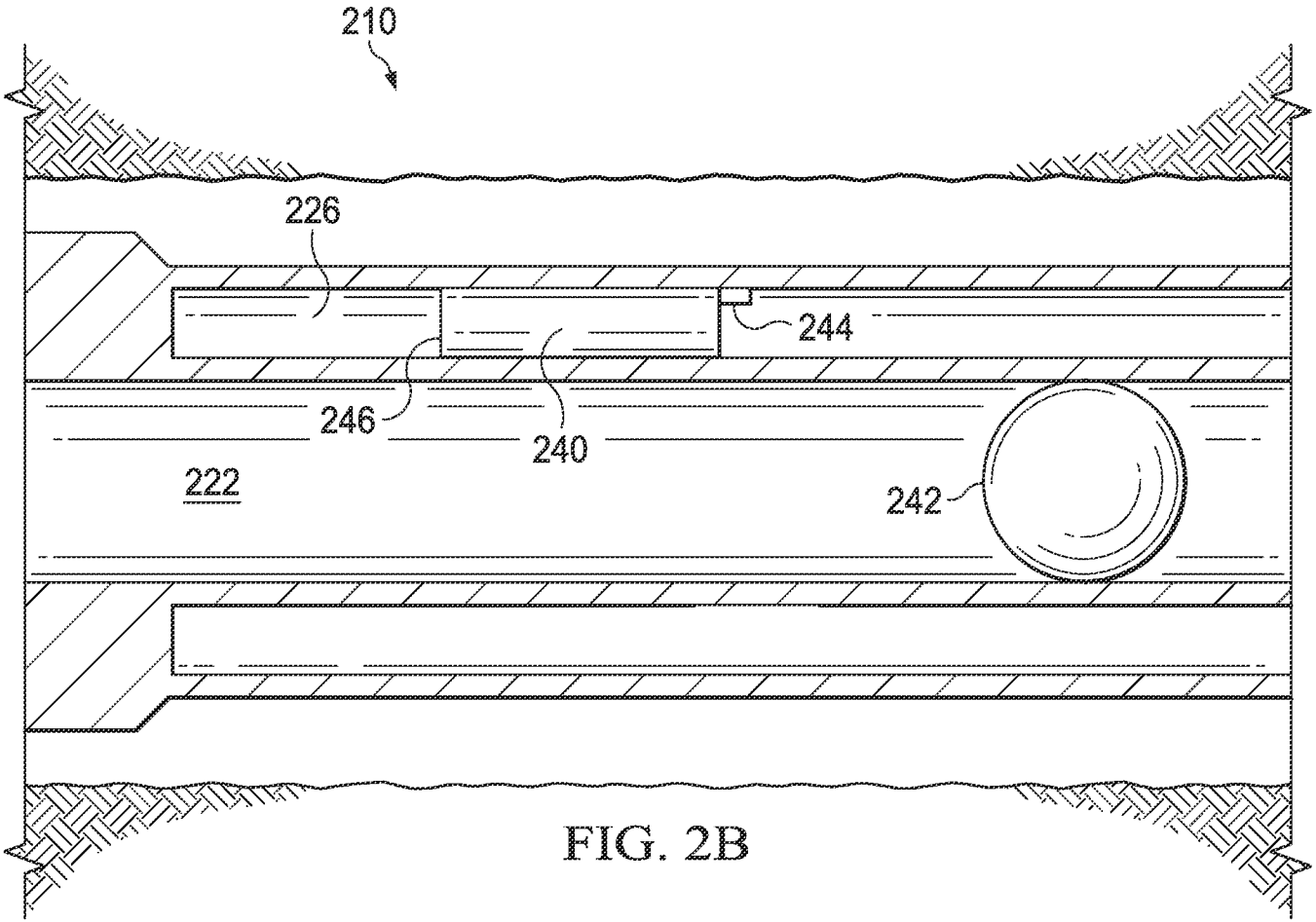
FIG. 2B illustrates a detailed cross-sectional view of a section of the high pressure ball valve of FIG. 2A including a piston and ball mechanism that are located downhole from the components shown in FIG. 2A.
Figure 3:
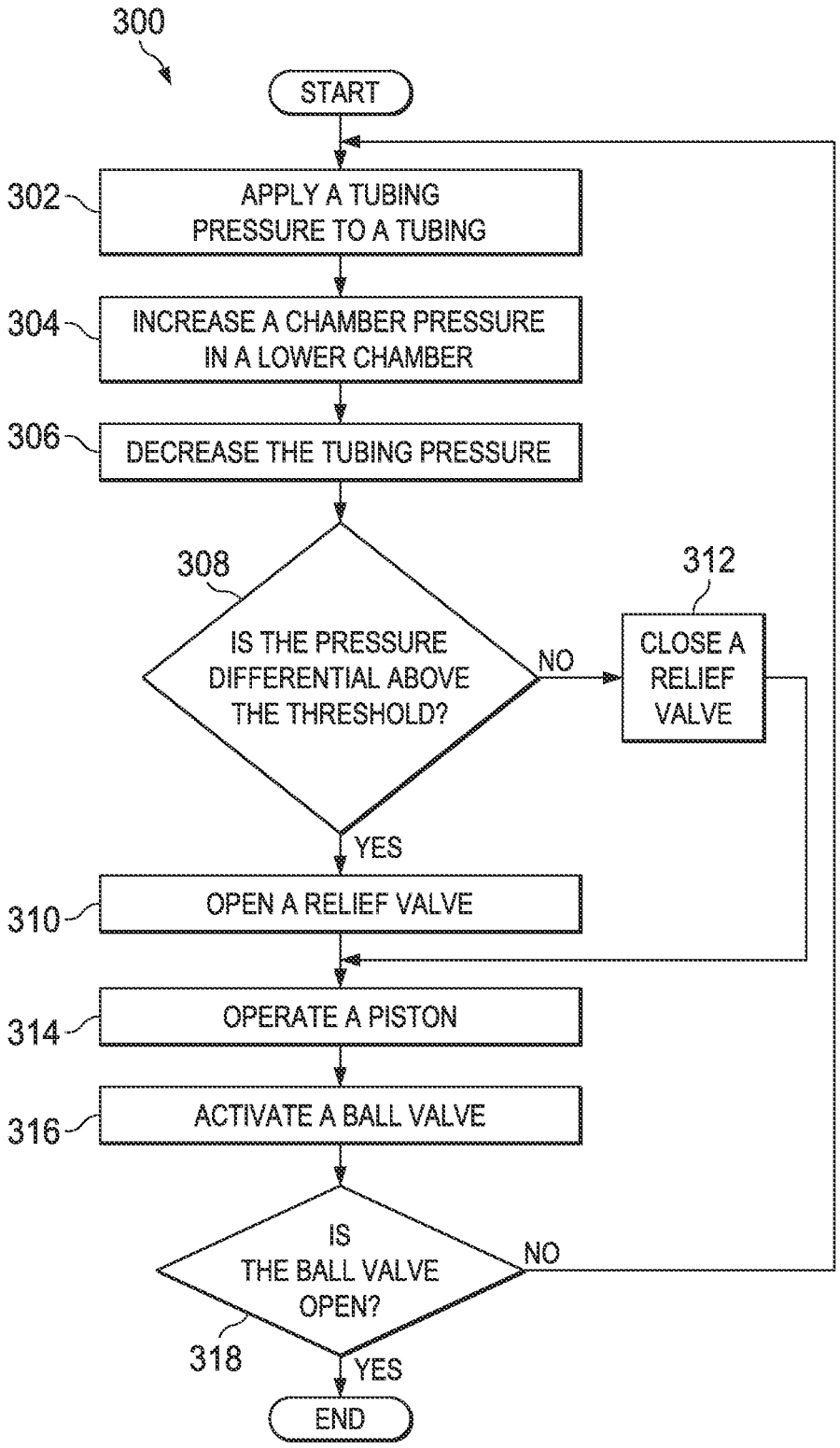
FIG. 3 illustrates a flow chart of a method for performing a pressure cycle used to operate a high pressure ball valve.
Figure 4:
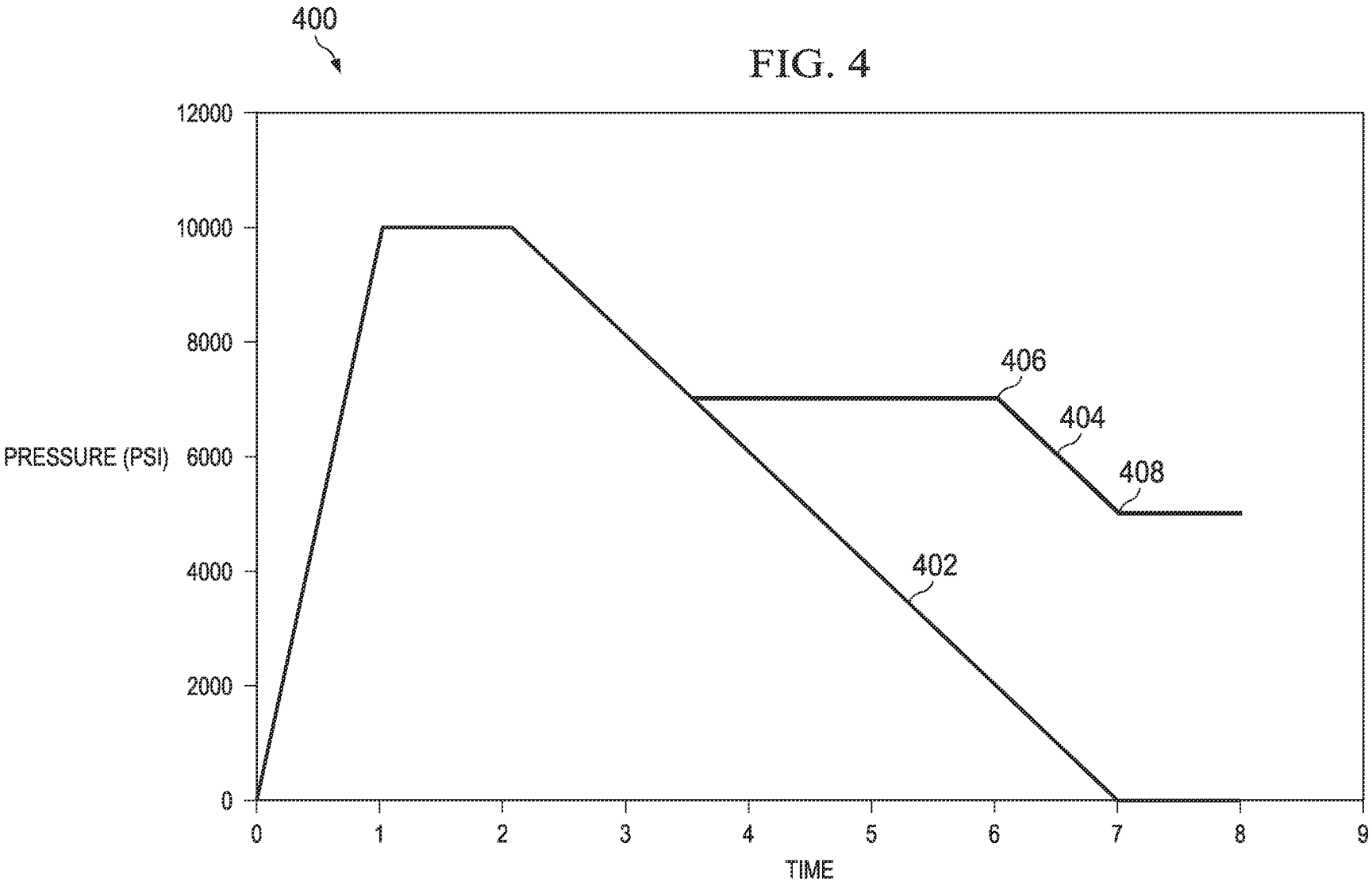
FIG. 4 illustrates a graph of a pressure cycle for a high pressure ball valve that includes regulation of a pressure differential using a relief valve.

After completion of a pressure cycle, some amount of residual pressure remains in an annulus of ball valve 110, as described in further detail with respect to FIGS. 2-4, creating a pressure differential between the pressure of the interior of ball valve 110 and the pressure in the annulus of ball valve 110. The amount of residual pressure remaining in the annulus of ball valve 110 is based on the amount of pressure applied to ball valve 110 during the pressure cycle. Ball valve 110 may be designed to isolate formation 108 under high pressure conditions. For example, ball valve 110 may be designed to withstand pressures of greater than 10,000 pounds per square inch and the pressure applied to ball valve 110 during a pressure cycle may be also be greater than approximately 10,000 pounds per square inch. Therefore, to reduce the amount of pressure differential between the pressure of the interior of the ball valve and the pressure in the annulus of the ball valve after the application of a high pressure cycle, ball valve 110 may include a relief valve (not expressly shown) to reduce the residual pressure in the annulus of ball valve 110. The reduction in the pressure differential allows portions of ball valve 110 to be designed using thinner materials and reduces the amount of deformation of ball valve 110 that may occur during high pressure conditions. Therefore, a high pressure ball valve designed according to the present disclosure reduces the cost and increases the reliability and performance of the high pressure ball valve.

FIG. 2A illustrates a cross-sectional view of an uphole end of a high pressure ball valve. FIG. 2B illustrates a cross-sectional view of the high pressure ball valve of FIG. 2A including a piston and ball mechanism that are located downhole from the components shown in FIG. 2A. High pressure ball valve 210 is attached to uphole completion equipment at end 212. The uphole completion equipment may be production tubing, wellbore testing equipment, or any other suitable equipment used in a wellbore completion operation. End 212 may be coupled to uphole completion equipment by threads 214 or any other suitable coupling mechanism such as a press fit, an interference fit, welding, crimp rings, or a combination thereof.

High pressure ball valve 210 includes outer wall 216 and inner wall 218. Annulus 220 is defined by the outside diameter of inner wall 218 and the inside diameter of outer wall 216. Tubing 222 is defined by the inside diameter of inner wall 218. Annulus 220 may be divided into multiple segments including upper chamber 224 and lower chamber 226. Lower chamber 226 may be filled with a compressible fluid, such as silicon oil other liquid or gas. Upper chamber 224 may be fluidically coupled to tubing 222 by inlets 228 such that fluids from tubing 222 flow into upper chamber 224 through inlets 228.

As described with respect to FIG. 3, during a pressure cycle a fluid, such as drilling fluid or water, is pumped downhole to high pressure ball valve 210. The fluid fills tubing 222 and enters upper chamber 224 through inlets 228. The fluid is pumped into tubing 222 until the pressure in tubing 222 reaches a predetermined level. For example, the pressure in tubing 222 of high pressure ball valve 210 may reach a level of 10,000 pounds per square inch, 15,000 pounds per square inch, or greater. The predetermined level may be the maximum differential rating of ball valve 210. As the pressure in tubing 222 increases, the pressure in upper chamber 224 also increases. Check valve 230 may allow fluid from upper chamber 224 to flow into lower chamber 226. The flow of fluid into lower chamber 226 increases the pressure in lower chamber 226. Check valve 230 may be a valve that allows fluid to flow in only one direction. For example, check valve 230 allows fluid to flow from upper chamber 224 to lower chamber 226 but not from lower chamber 226 to upper chamber 224. Therefore, because tubing 222, upper chamber 224, and lower chamber 226 are fluidically coupled, the pressures in tubing 222, upper chamber 224, and lower chamber 226 increase to the same pressure at the same rate during a pressure cycle, as described in further detail with respect to FIG. 4.

Once the pressure in tubing 222 reaches the predetermined level, the pressure in tubing 222 may be rapidly decreased by pumping the fluid from tubing 222. The pressure in tubing 222 may return to a pressure at or near atmospheric pressure. Initially, the pressure in upper chamber 224 may decrease at approximately the same rate as the pressure decreases in tubing 222 as the fluid flows from upper chamber 224 through inlets 228. However, once the pressure in lower chamber 226 reaches a predetermined percentage of the maximum pressure of the pressure cycle, for example approximately 60-90 percent, and check valve 230 act to trap the remaining pressure in lower chamber 226 and allow the pressure to slowly decrease. The trapped pressure creates a pressure differential between the pressure in lower chamber 226 and the pressure in tubing 222. The pressure differential may cause piston 240, shown in FIG. 2B, to move.

Due to the high pressure reached at the peak of the pressure cycle and the rapid decrease in the pressure in tubing 222, there may be a large pressure differential between the pressure in tubing 222 and the pressure in lower chamber 226. A large pressure differential between tubing 222 and lower chamber 226 may cause inner wall 218 to flex towards the center of tubing 222 such that the volume of lower chamber 226 increases. An increase in the volume of lower chamber 226 causes a decrease in the pressure in lower chamber 226. Over a number of pressure cycles, the flexing of inner wall 218 may impede the movements of the components of ball valve 210 due to the volume and pressure of lower chamber 226 deviating from the original design of lower chamber 226. For example, the flexing of inner wall 218 may displace the mechanical components of ball valve mechanism such that the alignment between the components changes and impedes the movement of the components.

Therefore, to reduce the flexing of inner wall 218, high pressure ball valve 210 may additionally include relief valve 234 that limits the differential pressure between tubing 222 and lower chamber 226. Relief valve 234 may be any type of relief valve suitable for use in hydraulic components under the conditions present in the wellbore environment. For example, relief valve 234 may be a spring operated valve, that opens when the force created by the differential pressure compresses the spring to open a nozzle on relief valve 234. Relief valve 234 may be designed to open at a predetermined pressure differential between the pressure of tubing 222 and the pressure of lower chamber 226. For example, when the pressure differential exceeds the predetermined pressure, the pressure may force relief valve 234 open. The predetermined pressure differential may be set to a value above the pressure differential required to operate ball mechanism 242 of high pressure ball valve 210, referred to as the minimum cycling pressure. While one relief valve 234 is shown in FIG. 3A, high pressure ball valve 210 may include multiple relief valves 234. Using multiple relief valves 234 may allow the pressure differential to be controlled in a quicker manner by allowing fluid to exit lower chamber 226 at a faster rate.

High pressure ball valve may additionally include sealing element 236 which prevents fluid from leaking between upper chamber 224 and lower chamber 226 at check valve 230, relief valve 234, or a combination thereof. Sealing element 236 may be any suitable sealing element, such as an O-ring, an X-ring, a D-ring, or a lip seal. The particular type of sealing element 236 may be selected to have an operating range corresponding to the maximum pressure differential between lower chamber 226 and tubing 222. The decrease in the pressure differential provided by relief valve 234 may decrease the operating range of sealing element 236 and allow a less expensive sealing element 236 to be used on high pressure ball valve 210 and reduce the likelihood of failure of sealing element 236.

High pressure ball valve 210 may additionally include piston 240 coupled to ball mechanism 242, as shown in FIG. 2B. Piston 240 may be fluidically coupled to lower chamber 226 such that during the pressure cycle, the pressure differential between lower chamber 226 and tubing 222 may apply a force on end 246 of piston 240 to cause piston 240 to move downhole.

During each pressure cycle, as the pressure in lower chamber 226 decreases, the force acting on piston 240 may decrease and the movement of piston 240 may stop. During the next pressure cycle, the pressure in lower chamber 226 may again apply a force to end 246 of piston 240 and move piston 240 downhole by another incremental amount. Each incremental movement of piston 240 may act on mechanical components of ball mechanism 242 which cause ball mechanism 242 to rotate from a closed position to an open position. Once piston 240 has moved its full length, piston 240 is no longer supporting a latch (not expressly shown) in ball mechanism 242. When supported, the latch compresses a spring (not expressly shown). When piston 240 moves such that the latch is not supported, the spring moves downward to exert a force on ball mechanism 242 to cause ball mechanism 242 to rotate from a closed to an open position. This process may continue through each pressure cycle until piston 240 has fully activated ball mechanism 242 to open the ball valve, thus allowing flow through high pressure ball valve 210.

FIG. 3 illustrates a flow chart of a method for performing a pressure cycle used to operate a high pressure ball valve. The steps of method 300 may be performed by an operator (e.g., a person or automation equipment located at the well site) that is configured to operate downhole tools during a subterranean operation, a component of the high pressure ball valve, or both. The components of the high pressure ball valve discussed with respect to FIG. 3 are described in more detail with respect to FIGS. 2A-B.

Method 300 may begin at step 302 where the operator may apply a tubing pressure to a tubing of a high pressure ball valve, such as tubing 222 shown in FIGS. 2A-2B while the ball valve is in a closed position. The tubing pressure may be applied by pumping a fluid, such as drilling fluid or water, downhole to the high pressure ball valve. Because the ball valve is closed, the fluid is trapped in the ball valve and the pressure in the tubing increases.

At step 304, the flow of fluid downhole to the high pressure ball valve may increase a chamber pressure in a lower chamber of the high pressure ball valve, such as lower chamber 226 shown in FIGS. 2A-2B. The lower chamber may be formed in an annular space between the tubing and the outer wall of the ball valve, as described in further detail with respect to FIGS. 2A-B. The pressure in the lower chamber increases due to fluid flowing from the tubing, into the annular space, and into the lower chamber. A check valve, such as check valve 230 shown in FIG. 2A, may be used to allow fluid to flow into the lower chamber, but prevent the flow of fluid from the lower chamber.

At step 306, the operator may decrease the tubing pressure by pumping the fluid uphole from the high pressure ball valve. As the tubing pressure decreases, a pressure differential may be created between the chamber pressure and the tubing pressure due to the check valve preventing the release of fluid and pressure from the lower chamber.

Steps 308 through 312 may be performed at any point during the pressure cycle when a pressure differential exists between the chamber pressure and the tubing pressure. At step 308, the relief valve, such as relief valve 234 shown in FIG. 2A may determine whether the pressure differential between the chamber pressure and the tubing pressure is above a threshold. The threshold may be a predetermined value that is greater than the minimum cycling pressure of the high pressure ball valve. If the pressure differential is above the threshold, method 300 may proceed to step 310. If the pressure differential is below the threshold, method 300 may proceed to step 312.

At step 310, the relief valve may open to reduce the pressure in the lower chamber. At step 312, the relief valve may close. The relief valve closes when the pressure differential falls below the threshold such that the pressure differential stays above the minimum cycling pressure of the ball valve. By opening and closing the relief valve, the relief valve may limit the pressure differential between the chamber pressure and the tubing pressure while maintaining the pressure differential above the minimum cycling pressure such that the ball valve mechanism is still activated. By limiting the pressure differential, the relief valve limits the range of pressures in the operating window used to operate the ball valve. Therefore, the thickness and flexing of the walls of the tubing may be reduced, thus reducing the cost and increasing the performance and reliability of the ball valve.

At step 314, the pressure differential may operate a piston, such as piston 240 shown in FIG. 2B. The piston may be fluidically coupled to the lower chamber such that the pressure in the lower chamber exerts a force on the piston and causes the piston to move. As the piston moves, the pressure in the lower chamber is reduced.

At step 316, the movement of the piston may activate the ball valve, such as ball valve 242 shown in FIG. 2B. The activation of the ball valve may move the ball valve from a closed position to an open position.

At step 318, the operator may determine whether the ball valve is open. The operation of the piston in step 314 and the activation of the ball valve mechanism in step 316 may be incremental, such that several pressure cycles may be completed before the piston has moved by an amount sufficient to open the ball valve. Therefore, if the ball valve is not open, method 300 may return to step 302 to perform the next pressure cycle which may activate the ball valve mechanism by the next increment. If the ball valve is open, method 300 may be complete.

The steps of method 300 may be completed in any order and some steps may be omitted or performed simultaneously with other steps. For example, the relief valve may be opened and closed at the same time the tubing pressure is decreasing and while the piston operates to activate the ball valve mechanism.

FIG. 4 illustrates a graph of a pressure cycle for a high pressure ball valve that includes regulation of a pressure differential using a relief valve. Line 402 of graph 400 is the pressure in the tubing, such as tubing 222 shown in FIGS. 2A-B, and line 404 is the pressure in the lower chamber, such as lower chamber 226 shown in FIGS. 2A-B. The pressure cycle begins when tubing pressure is applied to the high pressure ball valve and the pressure in the tubing increases. The pressure in the lower chamber also increases at approximately the same rate as the increase in the pressure in the tubing. Once the pressure reaches a predetermined level, such as the maximum pressure differential rating of the high pressure ball valve, the pressure momentarily stabilizes. In FIG. 4, the maximum pressure differential rating of the high pressure ball valve is approximately 10,000 pounds per square inch.

The pressure in the tubing may then be rapidly decreased to atmospheric pressure. Initially, the pressure in the lower chamber decreases at the same rate as the decrease in the pressure in the tubing. However, once the pressure in the lower chamber reaches a predetermined percentage of the maximum pressure of the pressure cycle, for example approximately 60-90 percent, a check valve act to trap the remaining pressure in the lower chamber. The trapped pressure creates a pressure differential between the pressure in the lower chamber and the pressure in the tubing. The pressure differential may cause a piston to move, as described with respect to FIGS. 2A-3.

When the difference between the pressure in the lower chamber and the pressure in the tubing exceeds the predetermined pressure differential setting of a relief valve included in the high pressure ball valve, the relief valve may open to control the pressure differential and allow the pressure in the lower chamber to decrease. In FIG. 4, the relief valve opens at point 406. The relief valve may remain open until the pressure differential between the pressure in the lower chamber and the pressure in the tubing falls below the predetermined pressure differential setting of the relief valve. At this point, shown as point 408 in FIG. 4, the relief valve may close and the pressure in the lower chamber may remain constant.

In this way, the relief valve acts to limit the maximum pressure differential (e.g., the maximum retained pressure in the lower chamber) to reduce flexing of an inner wall of the high pressure ball valve. The reduced flexing of the inner wall may allow the inner wall to be thinner and thus reduce the cost associated with manufacturing the high pressure ball valve.

Embodiments disclosed herein include:

A. A high pressure ball valve including an outer wall; an inner wall disposed in the outer wall; a tubing defined by an inner diameter of the inner wall; an annulus defined by an outer diameter of the inner wall and an inner diameter of the outer wall; a lower chamber formed in the annulus; and a relief valve fluidically coupled to the lower chamber, the relief valve to control a pressure differential between a pressure in the lower chamber and a pressure in the tubing.

B. A method for operating a high pressure ball valve including applying a tubing pressure to a tubing of a high pressure ball valve by pumping a fluid downhole to the tubing; increasing a chamber pressure in a lower chamber of the high pressure ball valve through fluid flow from the tubing to the lower chamber; decreasing the tubing pressure by pumping the fluid uphole from the tubing; and opening a relief valve fluidically coupled to the lower chamber if a pressure differential between the chamber pressure and the tubing pressure exceeds a predetermined threshold.

C. A subterranean operation system including a production tubing disposed in a wellbore; and a high pressure ball valve coupled to the production tubing. The high pressure ball valve including an outer wall; an inner wall disposed in the outer wall; a tubing defined by an inner diameter of the inner wall; an annulus defined by an outer diameter of the inner wall and an inner diameter of the outer wall; a lower chamber formed in the annulus; and a relief valve fluidically coupled to the lower chamber, the relief valve to control a pressure differential between a pressure in the lower chamber and a pressure in the tubing.

Each of embodiments A, B, and C may have one or more of the following elements in any combination: Element 1: further comprising a sealing element preventing a fluid flow between the upper chamber and the lower chamber at the relief valve. Element 2: further comprising a fluid disposed in the lower chamber. Element 3: wherein the fluid is a compressible fluid. Element 4: wherein the fluid is a silicone oil. Element 5: further comprising an inlet fluidically coupling the tubing, the annulus, and the lower chamber. Element 6: further comprising a check valve fluidically coupling the tubing and the lower chamber such that the check valve allows a fluid to flow into the lower chamber and prevents the fluid from flowing out of the lower chamber. Element 7: further comprising closing the relief valve when the pressure differential falls below the predetermined threshold. Element 8: further comprising operating a piston fluidically coupled to the lower chamber; and activating a mechanism to open the high pressure ball valve.

Although the present disclosure and its advantages have been described in detail, it should be understood that various changes, substitutions and alterations can be made herein without departing from the spirit and scope of the disclosure as defined by the following claims. For example, while the disclosure is described with respect to ball valves, aspects of the present disclosure may be adapted for use in other downhole tools activated based on cyclic pressure such as disappearing plugs.

What is claimed is:

1. A high pressure ball valve, comprising:

an outer wall;

an inner wall disposed in the outer wall;

a tubing defined by an inner diameter of the inner wall;

an annulus defined by an outer diameter of the inner wall and an inner diameter of the outer wall;

a lower chamber formed in the annulus; and a relief valve fluidically coupled to the lower chamber, the relief valve configured to close when a difference between a pressure in the lower chamber and a pressure in the tubing is below a minimum cycling pressure of a high pressure ball valve and open when the difference between the pressure in the lower chamber and the pressure in the tubing exceeds a pressure that causes the tubing to flex.

2. The high pressure ball valve of claim 1, further comprising a sealing element preventing fluid flow between an upper chamber and the lower chamber at the relief valve.

3. The high pressure ball valve of claim 1, further comprising a fluid disposed in the lower chamber.

4. The high pressure ball valve of claim 3, wherein the fluid is a compressible fluid.

5. The high pressure ball valve of claim 3, wherein the fluid is a silicone oil.

6. The high pressure ball valve of claim 1, further comprising an inlet fluidically coupling the tubing, the annulus, and the lower chamber.

7. The high pressure ball valve of claim 1, further comprising:

a check valve fluidically coupling the tubing and the lower chamber such that the check valve allows a fluid to flow into the lower chamber and prevents the fluid from flowing out of the lower chamber.

8. A method for operating a high pressure ball valve, comprising:

applying a tubing pressure to a tubing of a high pressure ball valve by pumping a fluid downhole to the tubing;

increasing a chamber pressure in a lower chamber of the high pressure ball valve through fluid flow from the tubing to the lower chamber;

decreasing the tubing pressure by pumping the fluid uphole from the tubing to create a pressure differential between the chamber pressure and the tubing pressure exceeds a minimum cycling pressure of the high pressure ball valve; and opening a relief valve fluidically coupled to the lower chamber if the chamber pressure exceeds the tubing pressure by a predetermined threshold, the predetermined threshold corresponding to a pressure that causes the tubing to flex.

9. The method of claim 8, further comprising closing the relief valve when a pressure differential between the chamber pressure and the tubing pressure falls below the predetermined threshold.

10. The method of claim 8, further comprising:

operating a piston fluidically coupled to the lower chamber; and activating a mechanism to open the high pressure ball valve.

11. The method of claim 8, wherein the lower chamber is filled with a fluid.

12. The method of claim 11, wherein the fluid is a compressible fluid.

13. The method of claim 11, wherein the fluid is a silicone oil.

14. A subterranean operation system, comprising:

a production tubing disposed in a wellbore; and a high pressure ball valve coupled to the production tubing, the high pressure ball valve including:

an outer wall;

an inner wall disposed in the outer wall;

a tubing defined by an inner diameter of the inner wall;

an annulus defined by an outer diameter of the inner wall and an inner diameter of the outer wall;

a lower chamber formed in the annulus; and a relief valve fluidically coupled to the lower chamber, the relief valve configured to close when a difference between a pressure in the lower chamber and a pressure in the tubing is below a minimum cycling pressure of the high pressure ball valve and open when the difference between the pressure in the lower chamber and the pressure in the tubing exceeds a pressure that causes the tubing to flex.

15. The subterranean operation system of claim 14, the high pressure ball valve further including sealing element preventing fluid flow between an upper chamber and the lower chamber at the relief valve.

16. The subterranean operation system of claim 14, the high pressure ball valve further including a fluid disposed in the lower chamber.

17. The subterranean operation system of claim 16, wherein the fluid is a compressible fluid.

18. The subterranean operation system of claim 17, wherein the fluid is a silicone oil.

19. The subterranean operation system of claim 14, the high pressure ball valve further including an inlet fluidically coupling the tubing, the annulus, and the lower chamber.

20. The subterranean operation system of claim 14, the high pressure ball valve further including:

a check valve fluidically coupling the tubing and the lower chamber such that the check valve allows a fluid to flow into the lower chamber and prevents the fluid from flowing out of the lower chamber.

* * * * *